US005474510A

United States Patent [19]

Chen

[11] Patent Number: 5,474,510

[45] Date of Patent: Dec. 12, 1995

[54] TREADMILL FRAME IMPROVEMENT

[76] Inventor: Hsien-juh Chen, 10th Fl., No. 6, Lane 124, Kuangyang Rd., Tantzu Hsiang, Taichung Hsien, Taiwan

[21] Appl. No.: 398,889

[22] Filed: Mar. 6, 1995

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS

| | | | |
|---|---|---|---|
| 3,703,284 | 11/1972 | Hesen | 482/54 |
| 4,616,822 | 10/1986 | Trulaske et al. | 482/54 |
| 5,072,928 | 12/1991 | Stearns et al. | 402/54 |
| 5,336,144 | 8/1994 | Rodden | 482/54 |
| 5,336,145 | 8/1994 | Keiser | 482/54 |

*Primary Examiner*—Lynne A. Reichard
*Attorney, Agent, or Firm*—Behr, Omri M.; Matthew J. McDonald

[57] ABSTRACT

A running exerciser assembly includes two side frames mounted in parallel with each other. Two plates each are horizontally formed on a top portion of a corresponding one of the two side frames, two L-shaped flange portions each are laterally formed on an upperside of a corresponding one of the two plates, and two cavities each are longitudinally defined between a corresponding one of the L-shaped flange portions and the associated plate and each face toward each other. Two recesses each are longitudinally defined in a bottom portion of a corresponding one of the two side plates and each include an opening facing toward each other. A supporting plate is mounted between the two side frees and includes two distal ends each securely fitted in a corresponding one of the two cavities. Two sliding posts each are slidably mounted in a corresponding one of the two recesses near a first end portion of the associated side free. A bracket includes a first end and a second end each securely mounted in a corresponding one of the two sliding posts. A pulling member is securely mounted on the first end of the bracket, a transmission wire includes a first distal end connected to outside and a second distal end connected to the pulling member for slidably moving the bracket.

4 Claims, 4 Drawing Sheets

TREADMILL FRAME IMPROVEMENT

BACKGROUND OF THE INVENTION

1. Field of Invention

The present invention relates to a running exerciser assembly.

2. Related Prior Art

A conventional running exerciser assembly is shown in FIGS. 4 and 5. However, by such an arrangement, there are still some shortcomings in the conventional running exerciser assembly.

There will be a more complete and sufficient illustration in the detailed description of the preferred embodiments, concerning the conventional running exerciser assembly.

The present invention has arisen to mitigate and/or obviate the disadvantages of the conventional running exerciser assembly.

SUMMARY OF THE INVENTION

The primary objective of the present invention is to provide a running exerciser assembly with a secure and stable engagement structure.

In accordance with one aspect of the present invention, there is provided a running exerciser assembly comprising a base member including two side frames mounted in parallel with each other and each having a first end portion and a second portion and having a top portion and a bottom portion. Two plates each are horizontally formed on the top portion of a corresponding one of the two side frames, two L-shaped flange portions each are laterally formed on an upperside of a corresponding one of the two plates, and two cavities each are longitudinally defined between a corresponding one of the L-shaped flange portions and the associated plate and each face toward each other. Two recesses each are longitudinally defined in the bottom portion of a corresponding one of the two side plates and each include an opening facing toward each other. A supporting plate is mounted between the two side frames and includes two distal ends each securely fitted in a corresponding one of the two cavities.

A shaft is rotatably mounted between the two side frames and includes a first end and a second end, and a driven wheel is fixedly mounted around the first end of the shaft to rotate therewith. A running belt forms a loop for enclosing the shaft and the supporting plate. Two sliding posts each are slidably mounted in a corresponding one of the two recesses near the first end portion of the associated side frame, a bracket is mounted adjacent the shaft and includes a first end and a second end each securely mounted in a corresponding one of the two sliding posts, a motor is securely mounted on the bracket and includes an axle located above the first end of the bracket, and a drive wheel is fixedly mounted around the axle. A transmission belt forms a loop for enclosing the drive wheel and driven wheel such that the drive wheel and driven wheel are rotated in concert. A pulling member is securely mounted on the first end of the bracket, and a transmission wire includes a first distal end connected to outside and a second distal end connected to the pulling member for slidably moving the bracket so as to move the drive wheel relative to the driven wheel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 5:
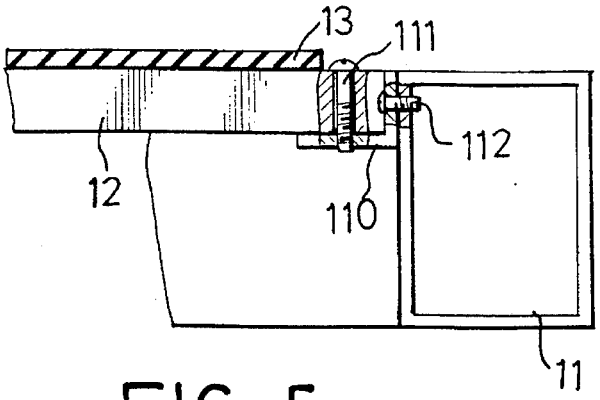
FIG. 5 PRIOR ART
FIG. 5 is a partially side cross-sectional assembly view of FIG. 4.
Figure 4:
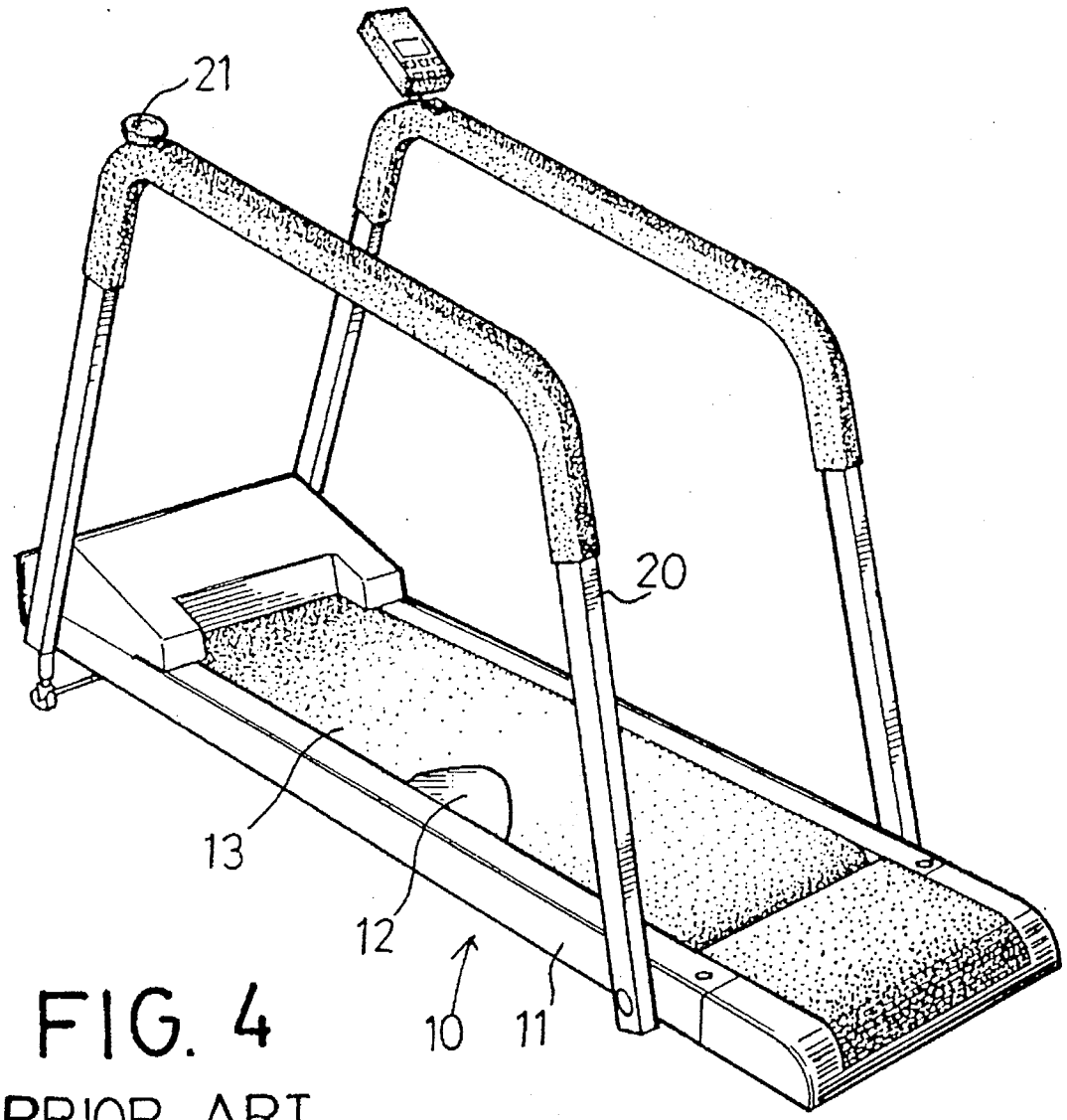
FIG. 4 PRIOR ART
FIG. 4 is perspective view of a conventional running exerciser assembly in accordance with the prior art.

Referring to FIGS. 4 and 5, a conventional running exerciser assembly in accordance with the prior art comprises a base member 10 including two side frames 11 mounted in parallel with each other. A supporting plate 12 is fixedly fitted between the two side frames 11 and a running belt 13 forms a loop for enclosing the supporting plate 12 so as to reciprocatingly move around the supporting plate 12 by means of a motor (not shown). Two substantially U-shaped handle portions 20 are respectively mounted beside a corresponding one of the two side frames 11, and a speed adjusting switch 21 is mounted on one of the two handle portions 20 for adjusting the traveling speed of the running strip 13.

In assembly, referring to FIG. 5, two substantially L-shaped positioning members 110 each include a vertical portion (not labeled) attached to a corresponding one of the two side frames 11 and a plurality of bolts 112 extend through the vertical portion of each of the two positioning members 110 and the associated side frame 11, thereby mounting each of the positioning members 110 to the associated side frame 11. The supporting plate 12 includes two distal ends each mounted on a horizontal portion (not labeled) of a corresponding one of the positioning members 110, and a plurality of bolts 111 extend through each of the distal ends of the supporting plate 12 and the associated horizontal portion of the positioning member 110, thereby mounting the supporting plate 12 on the positioning members 110.

By such an arrangement, the supporting plate 12 has to bear a heavy load, so the positioning members 110 will easily become loosened even being deformed during long-term utilization such that the engagement between the supporting plate 12 and the positioning members 110 is not stable, thereby easily causing an inconvenience in use, even being apt to cause injury to the user when the coupling structure thereof is destroyed.

Figure 1:
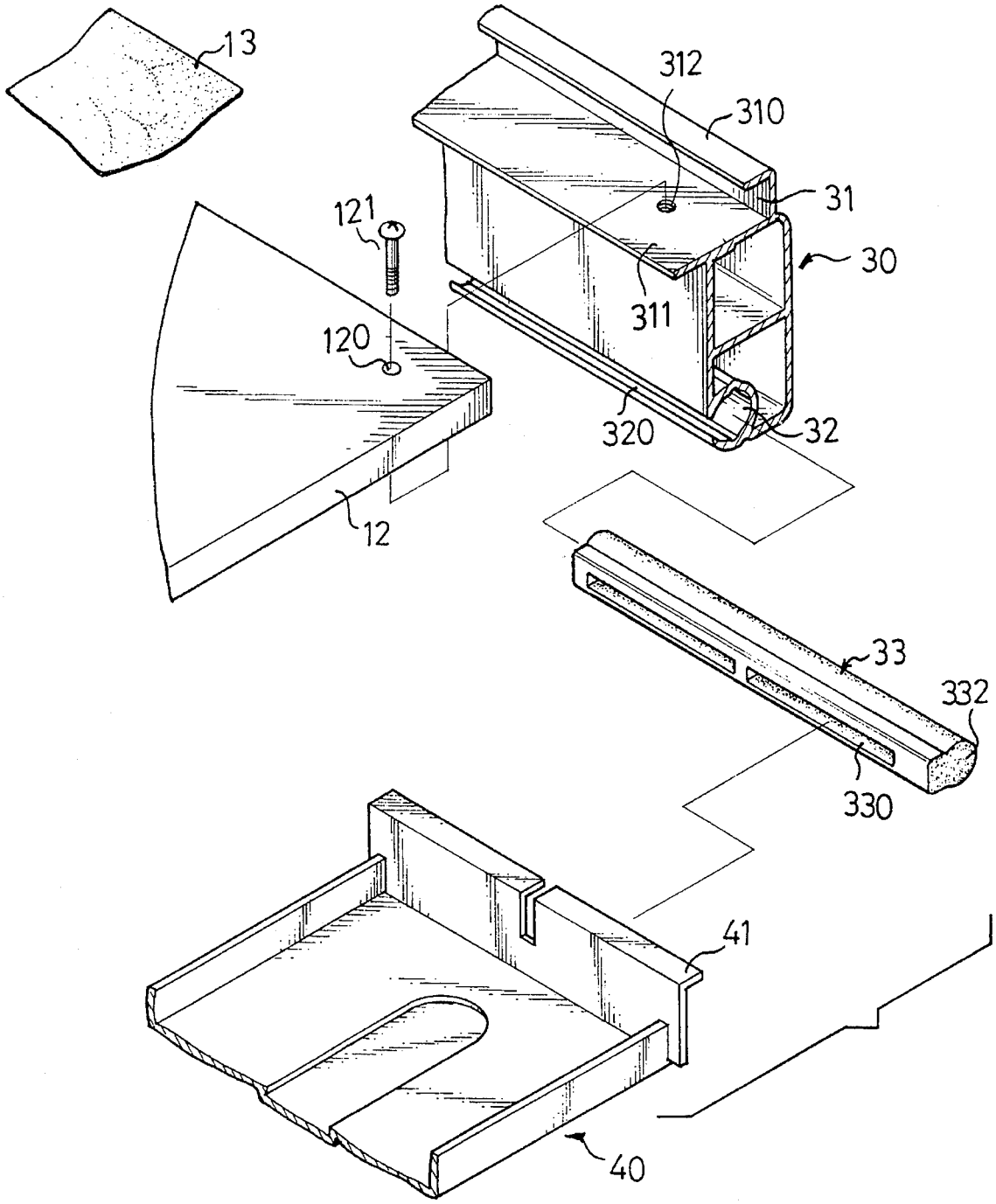
FIG. 1 is a partially exploded view of a running exerciser assembly in accordance with the present invention.
Figure 2:
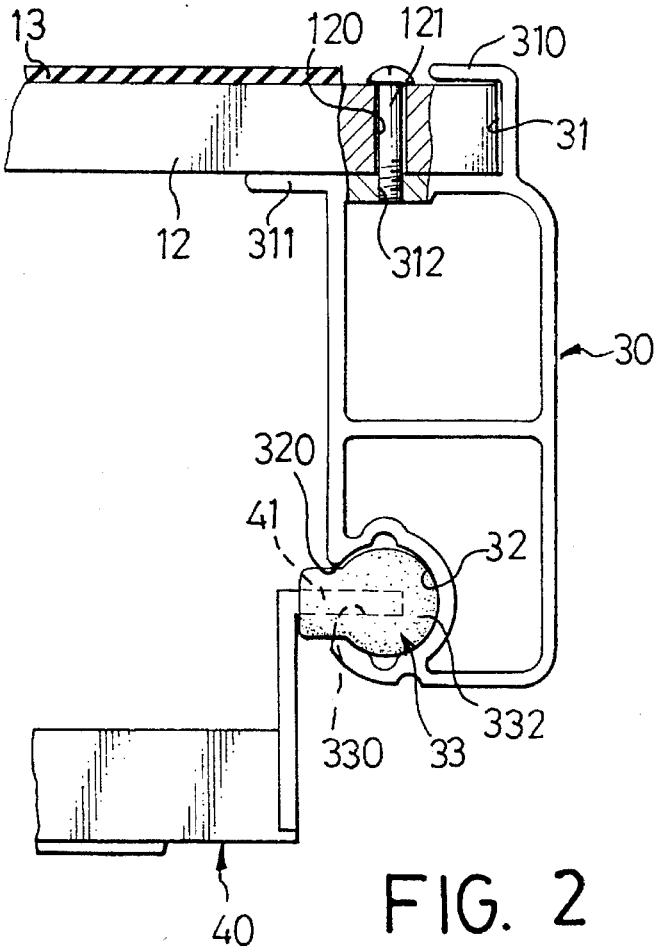
FIG. 2 is a side cross-sectional view of FIG. 1.
Figure 3:
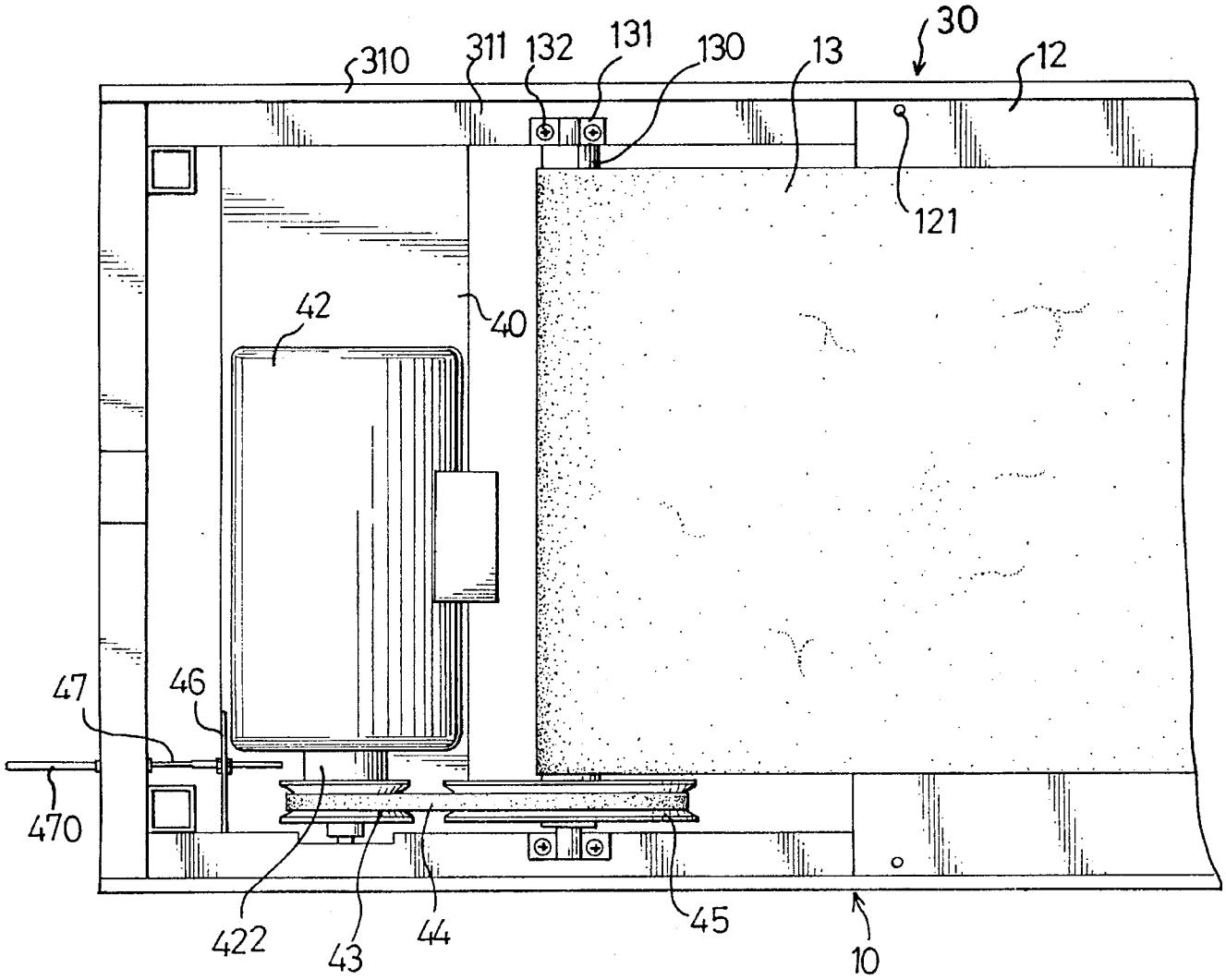
FIG. 3 is a partially top plan view of the running exerciser assembly.

Referring to FIGS. 1–3, a running exerciser assembly in accordance with the present invention comprises a base member 10 including two side frames 30 mounted in parallel with each other and each having a first end portion and a second portion and having a top portion and a bottom portion. Preferably, the two side frames 30 are integrally formed by extruding aluminum material through a molding die. Two plates 311 each are horizontally formed on the top portion of a corresponding one of the two side frames 30, two L-shaped flange portions 310 each are laterally formed on an upperside of a corresponding one of the two plates 311, and two cavities 31 each are longitudinally defined between a corresponding one of the L-shaped flange portions 310 and the associated plate 311 and each face toward each other. Two recesses 32 each are longitudinally defined in the bottom portion of a corresponding one of the two side plates 30 and each includes an opening 320 facing toward each other.

A supporting plate 12 is mounted between the two side frames 30 and includes two distal ends each securely fitted in a corresponding one of the two cavities 31. Preferably, each of the plates 311 includes a plurality of threaded holes 312 vertically defined therein, each of the distal ends of the supporting plate 12 includes a plurality of holes 120 vertically defined therethrough in alignment with a corresponding one of the threaded holes 312 of the associated plate 311, and a plurality of bolts 121 each extend through a corresponding one of the holes 120 and threadedly engage in the associated threaded hole 312, thereby securely and stably mounting the supporting plate 12 on the two plate 311 between the two side frames 30.

A shaft 130 is rotatably mounted between the two side frames 30 and includes a first end and a second end each rotatably mounted on the upperside of a corresponding one of the two plates 311, and a driven wheel 45 is fixedly mounted around the first end of the shaft 130 to rotate therewith. Preferably, two pivot bases 131 each are mounted around a corresponding one of the first and second ends of the shaft 130, and two pairs of positioning bolts 132 each extend through a corresponding one of the pivot bases 131 and engage in the associated plate 311 such that the first and second ends of the shaft 130 is able to rotate on the associated plate 311. A running belt 13 forms a loop for enclosing the shaft 130 and the supporting plate 12 such that a user may have his/her two feet stepping on the running strip 13.

Two sliding posts 33 each are slidably mounted in a corresponding one of the two recesses 32 near the first end portion of the associated side frame 30. Preferably, each of the recesses 32 is C-shaped in section, and each of the sliding posts 33 includes a lug portion 332 which is substantially circular in section with an enlarged diameter and is received in the associated recess 32, thereby facilitating each of the sliding posts 33 to move along the associated recess 32. A bracket 40 is mounted adjacent to the shaft 130 and includes a first end and a second end each securely mounted in a corresponding one of the two sliding posts 33. Preferably, each of the two sliding posts 33 includes two elongated slots 330 horizontally defined therein, and each of the first and second ends of the bracket 40 includes two projections 41 horizontally protruding outwardly therefrom and securely fitted in the two slots 330 of a corresponding one of the sliding posts 33, thereby securely mounting the bracket 40 between the two sliding posts 33.

A motor 42 is securely mounted on the bracket 40 and includes an axle 422 located above the first end of the bracket 40, and a drive wheel (or speed adjusting wheel) 43 is fixedly mounted around the axle 422 to rotate therewith. A transmission belt 44 forms a loop for enclosing the drive wheel 43 and the driven wheel 45 such that the drive and driven wheels 43 and 45 are rotated in concert. A pulling member 46 is securely mounted on the first end of the bracket 40, a transmission wire 47 includes a first distal end connected to outside with a cover 470 mounted therearound and a second distal end connected to the Dulling member 46 for slidably moving the bracket 40 and the motor 42 along the recesses 32 so as to move the drive wheel 43 relative to the driven wheel 45. Preferably, two substantially U-shaped handle portions (not shown) are respectively mounted beside a corresponding one of the two side frames 30, and a speed adjusting switch (not shown) is mounted on one of the two handle portions. The first distal end of the transmission wire 47 is connected to the speed adjusting switch for controlling the speed of the running exerciser assembly.

In practice, the motor 42 is actuated to rotate the rotary axle 422, thereby driving the drive wheel 43 to rotate so as to rotate the driven wheel 45 via the transmission belt 44, thereby rotating the shaft 130 such that the running strip 13 is moved around the shaft 130 and the supporting plate 12. By such an arrangement, the user is able to run on the running strip 13 for exercising. When wishing to vary the traveling speed of the running strip 13, the user may adjust the speed adjusting switch to draw the transmission wire 47 so as to move the bracket 40 together with the motor 42 via the pulling member 46 along the recesses 32, thereby horizontally displacing the drive wheel 43 relative to the driven wheel 45 so as to adjust the relative rotational speed ratio between the drive and driven wheels 43 and 45, thereby varying the traveling speed of the running strip 13.

It should be clear to those skilled in the art that further embodiments of the present invention may be made without departing from the teachings of the present invention.

What is claimed is:

1. A running exerciser assembly comprising:

a base member (10) comprising two side frees (30) mounted in parallel with each other and each including a first end portion and a second portion and including a top portion and a bottom portion, two plates (311) each horizontally formed on the top portion of a corresponding one of said two side frames (30), two L-shaped flange portions (310) each laterally formed on an upperside of a corresponding one of said two plates (311), two cavities (31) each longitudinally defined between a corresponding one of said L-shaped flange portions (310) and associated said plate (311) and each facing toward each other, and two recesses (32) each longitudinally defined in the bottom portion of a corresponding one of said two side plates (30) and each having an opening (320) facing toward each other;

a supporting plate (12) mounted between said two side frees (30) and including two distal ends each securely fitted in a corresponding one of said two cavities (31);

a shaft (130) rotatably mounted between said two side frames (30) and including a first end and a second end, and a driven wheel (45) fixedly mounted around the first end of said shaft (130) to rotate therewith;

a running belt (13) forming a loop for enclosing said shaft (130) and said supporting plate (12);

two sliding posts (33) each slidably mounted in a corresponding one of said two recesses (32) near the first end portion of associated said side frame (30);

a bracket (40) mounted adjacent said shaft (130) and including a first end and a second end each securely mounted in a corresponding one of said two sliding posts (33);

a motor (42) securely mounted on said bracket (40) and including a rotary axle (422) located above the first end of said bracket (40), and a drive wheel (43) fixedly mounted around said rotary axle (422);

a transmission belt (44) forming a loop for enclosing said drive wheel (43) and driven wheel (45) such that said drive wheel (43) and driven wheel (45) are rotated in concert; and a pulling member (46) securely mounted on the first end of said bracket (40), a transmission wire (47) including a first distal end connected to outside and a second distal end connected to said pulling member (46) for slidably moving said bracket (40) so as to move said drive wheel (43) relative to said driven wheel (45).

2. The running exerciser assembly in accordance with claim 1, wherein each of said two sliding posts (33) includes two elongated slots (330) horizontally defined therein, and each of said first and second ends of said bracket (40) includes two projections (41) horizontally protruding outwardly therefrom and securely fitted in said two slots (330) of a corresponding one of said sliding posts (33).

3. The running exerciser assembly in accordance with claim 1, wherein each of said recesses (32) is C-shaped in section, and each of said sliding posts (33) includes a lug portion (332) which is substantially circular in section with an enlarged diameter and is received in associated said recess (32).

4. The running exerciser assembly in accordance with claim 1, wherein each of said plates (311) includes a plurality of threaded holes (312) vertically defined therein, each of said distal ends of said supporting plate (12) includes a plurality of holes (120) vertically defined therethrough in alignment with a corresponding one of said threaded holes (312) of associated said plate (311), and a plurality of bolts (121) each extend through a corresponding one of said holes (120) and threadedly engage in associated said threaded hole (312).

* * * * *